US006273257B1

(12) United States Patent
Mossbeck

(10) Patent No.: US 6,273,257 B1
(45) Date of Patent: Aug. 14, 2001

(54) PACKAGED BEDDING PRODUCT

(75) Inventor: Niels S. Mossbeck, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 09/659,207

(22) Filed: Sep. 11, 2000

Related U.S. Application Data

(62) Division of application No. 09/327,396, filed on Jun. 7, 1999, now Pat. No. 6,178,723.

(51) Int. Cl.[7] ..... B65D 71/08; B65D 65/00
(52) U.S. Cl. ..... 206/497; 206/326; 229/87.01
(58) Field of Search ..... 206/326, 497; 53/430, 436, 438, 439, 434; 229/87.01

(56) References Cited

U.S. PATENT DOCUMENTS

| | | | | |
|---|---|---|---|---|
| 289,505 | * | 12/1883 | Crooke et al. | 229/87.01 |
| 801,279 | | 10/1905 | Van Slyke . | |
| 1,994,396 | | 3/1935 | Kilner . | |
| 2,260,064 | | 10/1941 | Stokes . | |
| 2,291,542 | * | 7/1942 | Filler | 229/87.01 |
| 2,700,459 | * | 1/1955 | Anspacher | 206/326 |
| 3,020,687 | | 2/1962 | Joa . | |
| 3,258,515 | | 6/1966 | Brown, Jr. . | |
| 4,418,514 | * | 12/1983 | Spann | 53/436 |
| 4,425,290 | | 1/1984 | Upmeier . | |
| 4,711,067 | | 12/1987 | Magni . | |
| 4,868,022 | | 9/1989 | Marx . | |
| 4,929,477 | | 5/1990 | Will . | |
| 5,158,816 | | 10/1992 | Rausing . | |
| 5,271,498 | | 12/1993 | Gillespie . | |
| 5,308,690 | | 5/1994 | Butcher, Jr. . | |
| 5,531,393 | | 7/1996 | Salzsauler et al. . | |
| 5,626,809 | | 5/1997 | Mortelmans . | |
| 5,626,944 | | 5/1997 | Rasmussen . | |
| 5,873,464 | | 2/1999 | Haley . | |
| 6,098,378 | * | 8/2000 | Wyatt | 53/430 |

* cited by examiner

*Primary Examiner*—Bryon P. Gehman
(74) *Attorney, Agent, or Firm*—Wood, Herron & Evans, LLP

(57) ABSTRACT

A method of packaging a bedding product in order to create a plastic film package in which the bedding product is individually packaged. First and second webs of extruded plastic film are unwound from first and second web rolls, passed between rollers and across opposed first and second surfaces of the bedding product before being cut and joined together in order to create a plastic film package. Each of the first and second webs have a uniform width and a varying thickness across the width in order to provide increased protection along the ends of the packaged bedding product.

10 Claims, 3 Drawing Sheets

PACKAGED BEDDING PRODUCT

CROSS REFERENCE TO RELATED APPLICATIONS

This application is a divisional application of U.S. patent application Ser. No. 09/327,396 filed Jun. 7, 1999 entitled METHOD OF PACKAGING A BEDDING PRODUCT, now U.S. Pat. No. 6,178,723 which is fully incorporated by reference herein.

FIELD OF THE INVENTION

This invention relates to the packaging of bedding products and more particularly to a method of packaging a single bedding product.

BACKGROUND OF THE INVENTION

For shipping purposes, bedding products such as mattresses and box springs are commonly placed on edge so that the bedding product is vertically oriented when being handled. Orienting a bedding product in such a fashion so that the bedding product rests upon one of the end surfaces of the bedding product makes the bedding product easier to handle and maneuver when the bedding product is being moved inside a warehouse or from a warehouse either onto or off a delivery truck.

Often bedding products are wrapped together in groups or bundles for shipping purposes. U.S. Pat. No. 5,271,496 discloses a package of bedding products comprising a base and a cap with a plurality of mattresses placed on edge between the base and the cap. The mattresses have aligned upper and lower edges and are wrapped together with an elastic material spirally wound about lateral edges of the mattresses.

Bedding products such as mattresses or box springs may also be individually wrapped. U.S. Pat. No. 801,279 discloses a fabric mattress envelope used to individually wrap a mattress. In addition to fibrous fabrics, mattresses may be wrapped in various types of plastics such as low density or high density polyethylene. However, when a single bedding product individually wrapped with a plastic film of a uniform thickness is shipped, the ends of the plastic wrapping material will rub against either the floor of a warehouse, the bottom of a truck or any other surface and "burn" holes in the plastic wrapping material, thus exposing the bedding product. In this manner bedding products become exposed to dirt, grease and other items which degrade the appearance of the bedding product, sometimes to the extent of preventing its sale to a customer.

One method of individually wrapping a single bedding product to provide increased protection at the ends of the bedding product has been to combine several strips or webs of plastic pulled from multiple rolls in order to increase the thickness of the side edges of the wrapping material. Narrow rolls of plastic film are unwound simultaneously with a main supply roll of plastic film before the strips are joined together along the side edges of the main web. Using this method, three strips or plies of plastic film are joined together to form a web which is passed above and below the bedding product. This method requires at least three separate supply rolls above and below the bedding product which must be unwound simultaneously before the strips pulled therefrom are joined together prior to wrapping the bedding product. Thus, this process is expensive. Furthermore the heat seals between the plastic films may sometimes fail, resulting in an opening exposing the bedding product.

Therefore, it has been one objective of the present invention to provide a method of packaging a bedding product in a plastic film which lessens the likelihood of "burning" holes in the plastic film and exposing portions of the bedding product.

It has been another objective of the present invention to provide a method of packaging an individual bedding product which utilizes only two supply rolls of packaging or wrapping material.

It has been a further objective of the present invention to provide a method of packaging a bedding product which results in the bedding product being enclosed in a plastic film package with increased protections at the ends of the package.

It has been a further objective of the present invention to provide a packaged bedding product wherein the plastic encasing the bedding product has an increased cross-sectional thickness along the end surfaces of the bedding product.

SUMMARY OF THE INVENTION

The invention of the application which accomplishes these objectives comprises a method of packaging a bedding product such as a mattress or a box spring. The bedding product has a uniform depth defined between a generally planar first surface and a parallel generally planar second surface. The bedding product further has a longitudinal dimension or length defined between a pair of opposed parallel end surfaces and a transverse dimension or width defined between a pair of opposed parallel side surfaces. The longitudinal dimension or length is greater than the transverse dimension or width of the bedding product in most bedding products. However, a square bedding product in which the longitudinal dimension and transverse dimension are equal may also be packaged using the method of this application.

The method of the present invention comprises providing first and second web rolls spaced from one another. The first web roll comprises a first web of extruded plastic film wound about a core into a roll. Similarly, the second web roll comprises a second web of extruded plastic film wound about a core into a roll. Each of the first and second webs of extruded plastic film have a pair of opposed side edges defining a width of the web. Across the width of the web each web has a varying thickness. More particularly, each web across its width has a pair of opposed side portions and a central portion between the side portions. The side portions are located proximate the opposed side edges of the web and are of a first cross-sectional thickness. The central portion between the side portions is of a second cross-sectional thickness, the second cross-sectional sectional thickness being less than the first cross-sectional thickness. Thus, the side portions of the web are thicker than the central portion of the web. This variation in cross-sectional thickness provides increased protection to the ends of the bedding product, once the bedding product is packaged.

The next step in the method is passing the first web of extruded plastic film past the first surface of the bedding product and the second web past the second surface of the bedding product on opposite sides of the bedding product. The bedding product is supported on a supporting surface and oriented such that the transverse dimension of the bedding product is generally parallel the opposed side edges of the first and second webs which are generally parallel one another. More particularly, the first and second webs are pulled from the first and second web rolls, respectively, and passed between a pair of spaced rollers before being passed transversely across the first and second surfaces of the bedding product. As the first and second webs are being pulled off of the first and second web rolls, respectively, the first and second web rolls rotate in opposite directions as do the rollers.

Once a sufficient length of the first and second webs are pulled from the first and second web rolls, the first and second webs are cut so as to create first and second pieces of extruded plastic film which are generally rectangular in shape and located on opposite sides of the bedding product. Therefore, the first piece of extruded plastic film covers the first surface of the bedding product, and the second piece of extruded plastic film covers the second generally planar surface of the bedding product.

The final step in the method of the present invention is to join the first and second pieces of extruded plastic film together about the periphery of the bedding product, thus enclosing the bedding product in a plastic film package, which preferably is airtight and water tight and protects the bedding product fully. The first and second pieces of extruded plastic film are preferably welded together but may be joined using any other conventional method. Therefore, a welded seam is created around the periphery of the bedding product. The excess plastic film located outside the seam may be cut away and removed.

Once the plastic film package is formed the bedding product is completely enclosed in plastic film, with the ends of the bedding product having increased protection due to the increased thickness of the extruded plastic film located at the ends of the bedding product. As a result, the bedding product may be slid along floors or subject to other abrasions on the end surfaces without "burning" holes in the plastic covering package.

These and other objects and advantages of this invention will be readily apparent from the following description of the drawings.

DETAILED DESCRIPTION OF THE DRAWINGS

Figure 1:
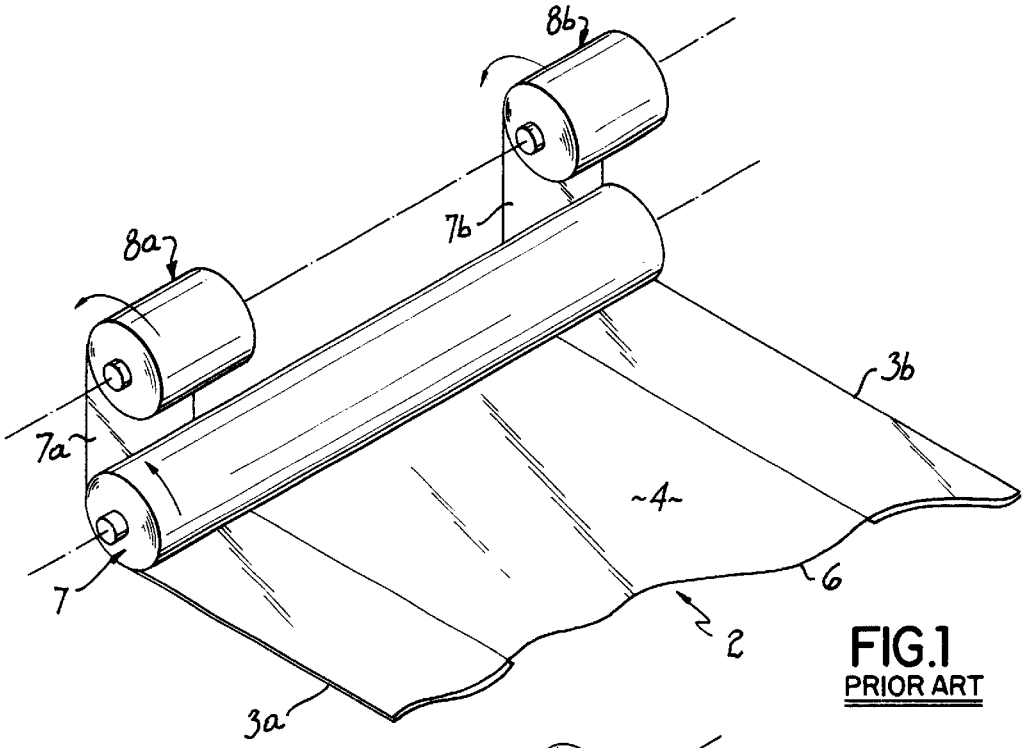
FIG.1 PRIOR ART
FIG. 1 is a perspective view of a prior art method of creating a continuous web of plastic material by combining three strips of plastic film, each unwound from a separate roll.

Referring to the drawings, and particularly to FIG. 1, there is illustrated a prior art method of creating a plastic web used to package a bedding product. This prior art plastic web 2 has a pair of double ply opposed side portions 3*a*,3*b* and a single ply middle portion 4 located between the side portions. The web 2 is created by welding together a first web 6 of a uniform cross-sectional thickness unwound from roll 7 and a pair of narrow reinforcing webs 7*a* and 7*b* unwound from rolls 8*a* and 8*b*, respectively. One difficulty with making such a web is that oftentimes folds are created in the plastic material when the plies are sealed or welded together. Another difficulty is that the sealer may not be hot enough to seal through all the layers, resulting in an unsealed section of the packaging surrounding the bedding product. The method of the present invention obviates one or more welding steps and uses fewer rolls of plastic packaging material, decreasing costs and resulting in a better packaged bedding product than products packaged using prior art methods.

Figure 2:
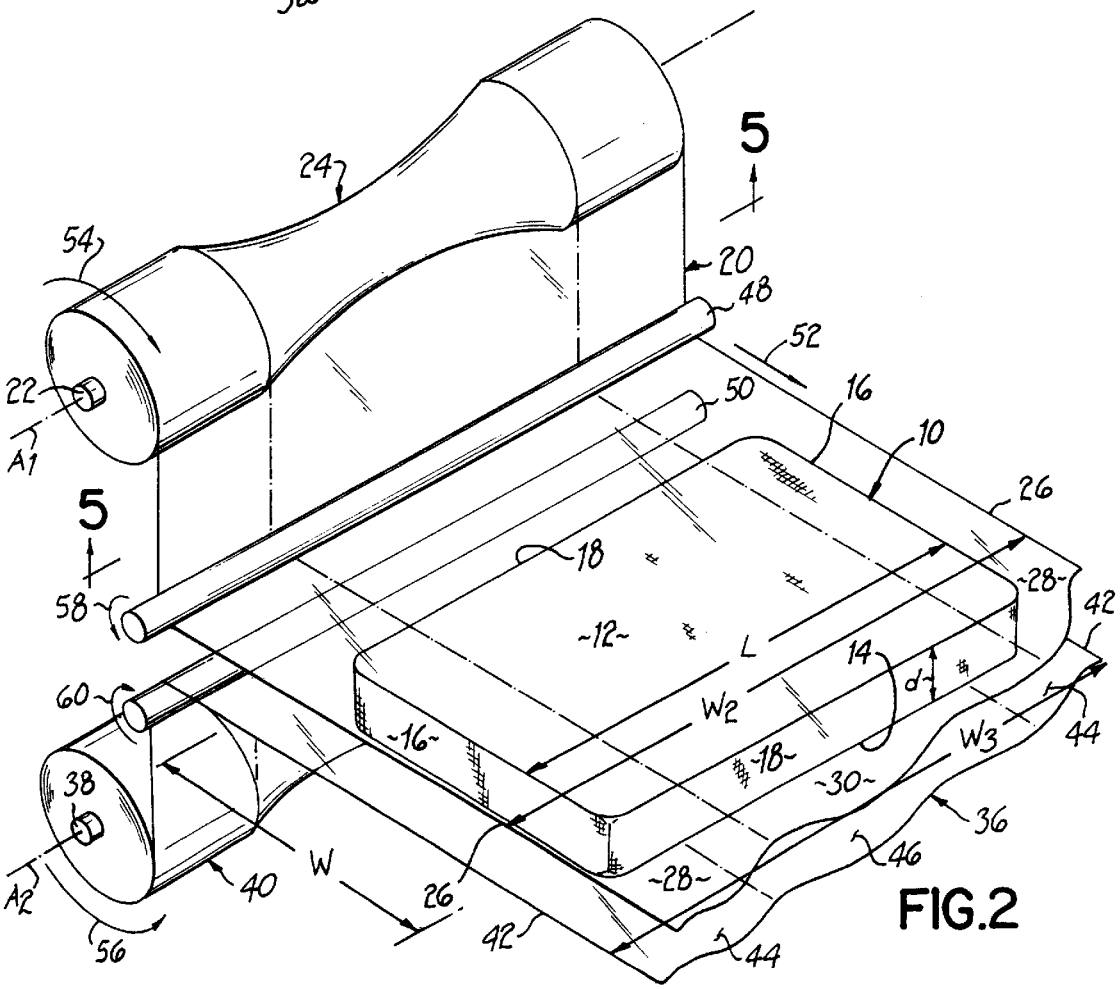
FIG. 2 is a perspective view of the first and second webs of the present invention being unwound from first and second web rolls, respectively, and passed above and below a bedding product.
Figure 3:
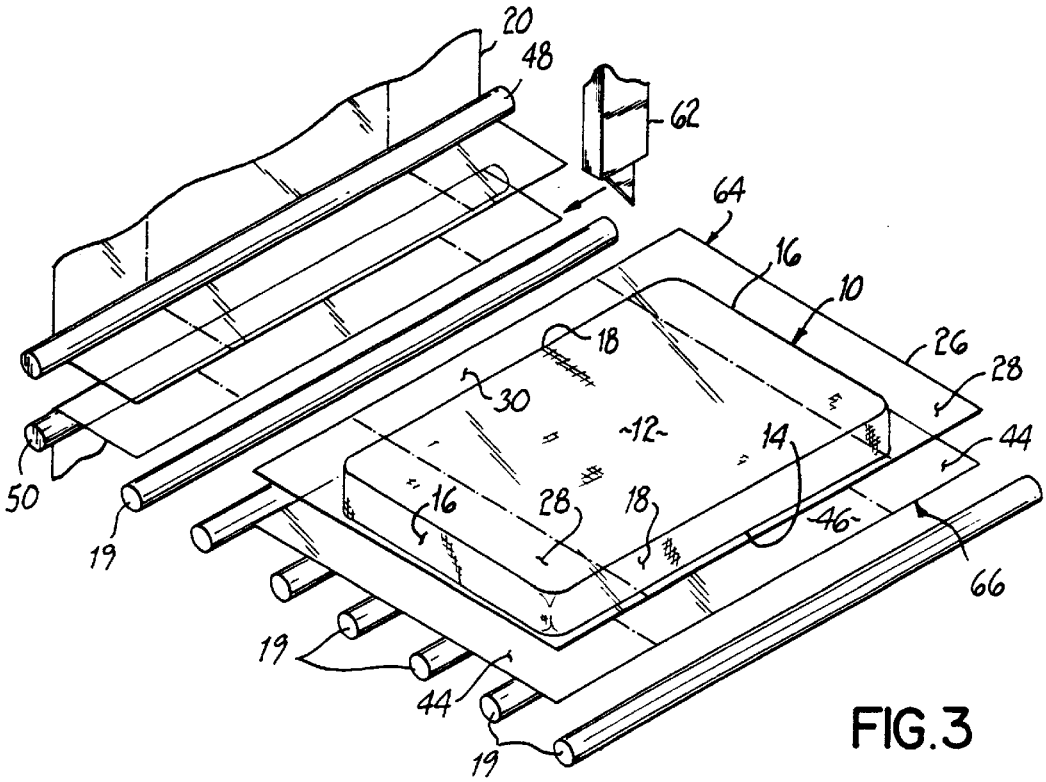
FIG. 3 is a perspective view of first and second pieces of extruded plastic film located above and below a bedding product.

FIGS. 2–5 illustrate the method of the present invention for packaging a bedding product. Referring to FIG. 2, the bedding product 10 has a generally planar first surface 12 and a parallel generally planar second surface 14. The generally planar first and second surfaces 12,14 are spaced apart a uniform distance d defining the depth of the bedding product. The bedding product 10 may be a mattress, box spring, foam cushion or other type of bedding or seating product. The bedding product 10 also has a pair of opposed generally planar, parallel end surfaces 16 which are spaced apart from one another a distance L which is the length or longitudinal dimension of the bedding product. Similarly, the bedding product has a pair of opposed generally planar side surfaces 18 which are spaced apart from one another and generally parallel. The distance between the opposed side surfaces 18 is equal to the width or transverse dimension W of the bedding or seating product. As illustrated in FIG. 2, the bedding product 10 may be oriented horizontally so that the first and second surfaces are generally horizontal. Alternatively, the bedding product may be oriented such that the first and second surfaces are generally vertical, although such an orientation is not illustrated. Other orientations may be utilized in accordance with the present invention as well. The bedding product 10 is illustrated in FIG. 3 as being supported by a plurality of spaced rollers 19. However the bedding product 10 may be supported by any number of different mechanisms such as an endless conveyor belt.

Figure 5:
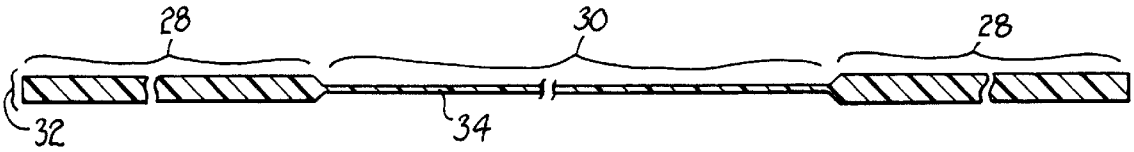
FIG. 5 is a view taken along the line 5—5 of FIG. 2.

Referring to FIG. 2, a first web 20 of extruded plastic film is wound about a core 22 into a first web roll 24. As illustrated in FIG. 2, the first web 20 has a pair of opposed side edges 26, the distance between the side edges 26 defines the width $W_2$ of the first web. Although the first web 20 is a unitary piece of plastic, it has differing cross-sectional thicknesses across its width, as best illustrated in FIG. 5. Across the width of the first web, the first web 20 is divided into a pair of opposed side portions 28 proximate the side edges 26 and a central portion 30 located between the side portions 28.

As best illustrated in FIG. 5, the side portions 28 of the first web 20 each have an identical uniform cross-sectional first thickness 32. The central portion 30 has a uniform cross-sectional second thickness 34, the second cross-sectional thickness 34 being less than the first cross-sectional thickness 32.

Referring to FIG. 2, a second web 36 of extruded plastic film is wound about a core 38 into a second web roll 40. Like the first web, the second web 36 has a pair of opposed side edges 42, the distance between the side edges 42 defining the width $W_3$ of the second web. As seen in FIG. 2, the widths $W_2$,$W_3$ of the first and second webs are approximately identical, although they need not necessarily be so.

Like the first web, the second web 36 is divided across its width into three separate portions, a pair of opposed side portions 44 proximate the side edges 42 and a central portion 46 located between the pair of side portions 44. The second web has a cross-sectional configuration similar to the cross-sectional configuration of the first web (illustrated in FIG. 3), the side portions having an identical first cross-sectional thickness across their widths and the central portion having a uniform cross-sectional thickness across its width. The cross-sectional thickness of the side portions is greater than the cross-sectional thickness of the central portion.

As illustrated in FIG. 2, the first web roll 24 is spaced above the second web roll 40. A pair of spaced rollers 48 and 50 are located between the web rolls 24,40 and slightly in front thereof. However, the web rolls 24,40 may be at other locations not specifically illustrated in FIG. 1 without departing from the spirit of the invention of this application. Similarly, the location of the rollers may be changed from the locations illustrated in FIG. 2 without departing from the spirit of the invention of this application.

The first and second webs 20,36 are pulled from the first and second web rolls 24,40, respectively, passed between the spaced rollers 48 and 50 and past the bedding product 10. The bedding product 10 is oriented so that the end surfaces 16 of the bedding product 10 and transverse dimension of the bedding product are generally parallel the opposed side edges 26,42 of the aligned first and second webs 20,36, respectively. The first web 20 of extruded plastic film is passed over the first surface 12 of the bedding product 10 slightly above the first surface 12 of the bedding product. Similarly, the second web 36 is passed under the second surface 14 of the bedding product 10 slightly below the second surface. Each of the first and second webs are pulled in the direction of arrow 52 (from left to right in FIG. 2) across the entire width W of the bedding product.

As the first and second webs 20,36 are being pulled off of the first and second web rolls 24,40, respectively, the first web roll 24 rotates in the direction of arrow 54 about a transversely extending axis $A_1$, and the second web roll 40 rotates in the direction of arrow 56 about a transversely extending axis $A_2$. As illustrated in FIG. 2, the first and second web rolls 24,40 rotate in opposite directions. Contact between the first web 20 and the first roller 48 causes the first roller to rotate in a direction indicated by the arrow 58 opposite to the direction of rotation the first web roll 24 (see arrow 54). Similarly, as the second web 36 passes over and contacts the second roller 50, the second roller rotates in the direction of arrow 60 which is opposite to the direction of rotation of the second web roll 40 (see arrow 56).

As illustrated in FIG. 3, once a sufficient length of the first and second webs 20,36 are pulled from the first and second web rolls 24,40, respectively, pass between the first and second rollers 48,50 and across the width of the bedding product 10, the first and second webs are cut with a cutting instrument 62. The cutting instrument is illustrated as being a knife but may be any other type of cutting device including, but not limited to, a laser, a heated bar or cutting wheel. Although only one cutting instrument is illustrated, more than one cutting instrument may be used. The cutting instrument 62 passes transversely across the width of the first and second webs 20,36 so as to create first and second pieces 64,66 of extruded plastic film from the first and second webs, respectively. The first and second pieces of extruded plastic film 64,66 are located on opposite sides of the bedding product and extend beyond the periphery of the bedding product in order for the first and second pieces to be joined together about the periphery of the bedding product.

Figure 4:
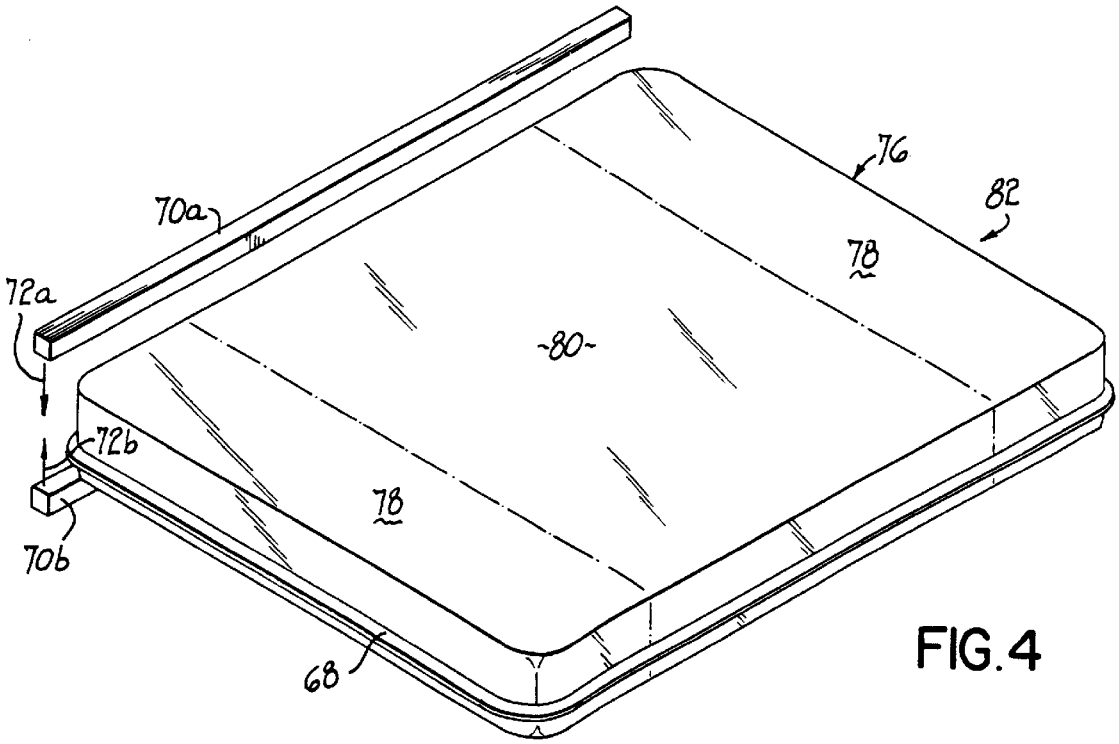
FIG. 4 is a perspective view of a bedding product individually wrapped in a plastic film package after the first and second pieces of extruded plastic film shown in FIG. 3 are welded together.

The final step in the method of packaging a bedding product in accordance with the present invention is to join the first and second pieces of extruded plastic film 64,66 together about the periphery of the bedding product with a seam 68 as shown in FIG. 4. The seam 68 is illustrated in FIG. 4 as extending halfway up the end and side surfaces of the bedding product but may be located in other positions as well. The first and second pieces of extruded plastic film 64,66 may be joined together using any conventional method including staples, glue, etc. but are preferably welded or heat sealed together.

The joining of the first and second pieces of extruded plastic film 64,66 may be accomplished using any of numerous methods, one of which is illustrated in FIG. 4. Using this method, two welding bars 70*a*,70*b* are located along one side of the bedding product 10. The welding bars 70*a*,70*b* are moved in the direction of arrows 72*a* and 72*b*, respectively, after being heated to a sufficient temperature in order to melt the plastic film of the first and second webs together. Although only two welding bars located along one side of the bedding product are illustrated, four sets of such welding bars preferably surround the entire periphery of the bedding product, thus ensuring a seal around the complete periphery of the bedding product.

The extruded plastic film used in accordance with the method of the present invention may be any plastic material. One type of plastic material which has proven to work well using the present invention is high density polyethylene. However, this application is not intended to limit the plastic material used in accordance with the present invention.

As illustrated in FIG. 4, once the first and second pieces 64,66 of extruded plastic film are joined together along all four sides of the bedding product, the result is a single ply plastic film package 76. The single ply package 76 has a pair of end portions 78 and a middle portion 80 therebetween. The end portions 78 are of a larger cross-sectional thickness than the cross-sectional thickness of the middle portion 80. The end portions 78 being of an increased cross-sectional thickness increases the protection afforded the ends of the bedding product and enables the bedding product to be slid along floors or other abrasive surfaces without burning holes in the single ply plastic package 76. Therefore, the method of the present invention results in a packaged bedding product 82 which has a greater structural integrity than heretofore known. Additionally, the packaged bedding product of the present invention may be made using the method of the present application more quickly and less expensively than has heretofore been possible.

Although not specifically illustrated, the bedding product may be oriented so that the side surfaces of the bedding product are generally parallel the side edges of the first and second webs. If the bedding product is so oriented, the longitudinal dimension and side surfaces of the bedding product are generally parallel the side edges of the first and second webs, respectively, and the resulting packaged product has increased protection along the side surfaces of the bedding product rather than along the end surfaces of the bedding product.

Although I have described only one preferred method of packaging a bedding product, other variations and slight modifications to this method will be apparent to those skilled in the art such as, for example, orienting the bedding product in different orientations while being packaged. Therefore, I do not intend to be limited except by the scope of the following claims:

I claim:

1. A packaged bedding product having a depth defined between opposed first and second surfaces, a length defined between a pair of opposed end surfaces and a width defined between a pair of opposed side surfaces, said bedding product being encased in a plastic film package, said plastic film package comprising first and second pieces of plastic joined together along all four sides of said bedding product, each of said pieces of plastic comprising a single ply layer of varying cross sectional thickness.

2. The packaged bedding product of claim 1 wherein said length is greater than said width.

3. The packaged bedding product of claim 1 wherein said pieces of said plastic film package are welded together.

4. A packaged bedding product comprising:

a bedding product having a depth defined between opposed generally parallel first and second surfaces, a length defined between a pair of opposed end surfaces and a width defined between a pair of opposed side surfaces, a single ply plastic film package encasing said bedding product, said plastic film package comprising first and second pieces of plastic joined around a perimeter of said bedding product, each of said pieces of plastic having a pair of end portions and a middle portion therebetween, said end portions having a first cross-sectional thickness, said middle portion having a second cross-sectional thickness, said first cross-sectional thickness being greater than said second cross-sectional thickness.

5. The packaged bedding product of claim 4 wherein said length is greater than said width.

6. The packaged bedding product of claim 4 wherein said pieces of said plastic film package are welded together.

7. A packaged bedding product comprising:

a bedding product having a depth defined between opposed first and second surfaces, a length defined between a pair of opposed end surfaces and a width defined between a pair of opposed side surfaces, a single ply plastic film package encasing said bedding product, said single ply plastic film package comprising first and second pieces of plastic joined around a perimeter of said bedding product, each of said pieces of plastic having a pair of outer portions and a middle portion therebetween, said outer portions having a greater cross-sectional thickness than said middle portion of said piece of plastic to protect portions of said bedding product.

8. The packaged bedding product of claim 7 wherein said outer portions of said pieces of plastic cover said opposed side surfaces of said bedding product.

9. The packaged bedding product of claim 7 wherein said outer portions of said pieces of plastic cover said opposed end surfaces of said bedding product.

10. The packaged bedding product of claim 7 wherein said pieces of said plastic film package are welded together.

* * * * *